US012416460B2

(12) United States Patent
Hell et al.

(10) Patent No.: US 12,416,460 B2
(45) Date of Patent: Sep. 16, 2025

(54) RECEIVER ASSEMBLY FOR A HANDGUN

(71) Applicant: Glock Technology GmbH, Ferlach (AT)

(72) Inventors: Sebastian Hell, Weikendorf (AT); Ralph Morgenfurt, Auersthal (AT); Juergen Gunsam, Prottes (AT)

(73) Assignee: Glock Technology GmbH (AT)

( * ) Notice: Subject to any disclaimer, the term of this patent is extended or adjusted under 35 U.S.C. 154(b) by 0 days.

(21) Appl. No.: 18/723,402

(22) PCT Filed: Dec. 23, 2022

(86) PCT No.: PCT/AT2022/060463

§ 371 (c)(1),
(2) Date: Jun. 21, 2024

(87) PCT Pub. No.: WO2023/115094

PCT Pub. Date: Jun. 29, 2023

(65) Prior Publication Data

US 2025/0060178 A1 Feb. 20, 2025

(30) Foreign Application Priority Data

Dec. 23, 2021 (EP) ..... 21217339

(51) Int. Cl.
*F41A 3/66* (2006.01)
*F41A 17/56* (2006.01)

(52) U.S. Cl.
CPC ..... *F41A 3/66* (2013.01); *F41A 17/56* (2013.01)

(58) Field of Classification Search
CPC ..... F41A 3/66; F41A 11/00
See application file for complete search history.

(56) References Cited

U.S. PATENT DOCUMENTS

| | | | |
|---|---|---|---|
| 8,950,100 | B2 | 2/2015 | Nebeker |
| 9,303,936 | B2 | 4/2016 | Toner |
| 9,689,635 | B2 | 6/2017 | Krieger |
| 10,724,814 | B2 | 7/2020 | Thomele |
| 2017/0104300 | A1 | 4/2017 | De Jong |
| 2017/0184366 | A1 | 6/2017 | Zajk |
| 2020/0080801 | A1 | 3/2020 | O'Clair |

FOREIGN PATENT DOCUMENTS

| | | | |
|---|---|---|---|
| DE | 102013022080 | B3 | 7/2014 |
| EP | 2294351 | A1 | 3/2011 |
| WO | 2009048668 | A1 | 4/2009 |
| WO | 2009156774 | A1 | 12/2009 |

*Primary Examiner* — Reginald S Tillman, Jr.
(74) *Attorney, Agent, or Firm* — Fishman Stewart PLLC

(57) ABSTRACT

A receiver assembly for a handgun. The receiver assembly includes a receiver having a magazine well, a locking device having a locking lever for actuating the locking device, a control block accommodated in the receiver, a trigger pivotable in the receiver and about a trigger axis, a sear bar coupled to the trigger, a locking bar having a guide lug, and a lowering component accommodated in the control block, which has a bar guide slot formed therein. The sear bar extends to the control block and includes a guide bracket. The locking bar interacts with the locking device. The lowering component is displaceable for removing the slide assembly from the receiver assembly. The lowering component includes a control window and a guide link. The guide bracket is guided in the control window. The guide lug protrudes into the guide link and through a bar guide slot of the control block.

20 Claims, 11 Drawing Sheets

RECEIVER ASSEMBLY FOR A HANDGUN

CROSS REFERENCE TO RELATED APPLICATIONS

This application is a US National Phase Application of PCT/AT2022/060463, filed Dec. 23, 2022, which claims priority to EP21217339.7, filed Dec. 23, 2021. The contents of both these application are hereby incorporated by reference in their entirety.

TECHNICAL FIELD

The invention relates to a receiver assembly for a handgun, to a handgun equipped with the receiver assembly, and to a lowering component for a handgun.

BACKGROUND

The handgun according to the invention can be a pistol.

There are countless handguns known from the prior art in which the slide assembly is removed from the receiver assembly after actuation of the trigger.

US 2017/104300 A1 discloses a pistol with right and left members of sear connector actuator which are movable independently of each other. Right member includes a laterally extending actuating post configured and arranged to engage a trigger bar for slideably moving the actuator forward in a firing control housing insert.

EP 2294351 B1 discloses a mechanism for disassembling a handgun without using the trigger. The mechanism comprises a disassembler that has a lever positioned on the outside of a handgun receiver. The disassembly mechanism further comprises a catch lever, sear catch, and a sear catch spring. The disassembler has an eccentric pin which is moved through a quarter circle by rotating the disassembly lever in such a manner that it moves the catch lever in the forward direction parallel to the plane of movement of the slide on the receiver.

The mechanism of EP 2294351 B1 has the disadvantage that the eccentric pins can bend, which can impair the functionality of the mechanism.

DE 102013022080 B3 discloses a device for preventing the tensioning of a firing pin spring, more precisely a device for preventing the tensioning of a firing pin spring during the disassembly of a striker-fired self-loading pistol equipped with a slide. Such a device can assume a disarming position and/or locking position, and a disassembly position, and has: a spring-loadable firing pin with a lug formed thereon for operative engagement with a sear, which protrudes into the path of movement of the sear in the tensioning position for tensioning the firing pin spring, and which is out of operative engagement with the lug in the disassembly position, and a sear bar coupled to a trigger, which in the disassembly position brings the sear out of engagement with the lug.

The mechanism of DE 102013022080 B3 is also prone to errors due to its design.

Further devices for the disassembly of pistols are known from U.S. Pat. Nos. 9,303,936 B2, 10,724,814 B2 and 8,950,100 B2. The constructions disclosed in these documents are also in need of improvement.

As can be seen from the cited documents relating to the prior art, many attempts have been made to create alternative mechanisms for the disassembly of the handgun allowing for the disassembly of the handgun without pulling the trigger.

SUMMARY

The object of the present invention was to overcome the disadvantages of the prior art with respect to the disassembly mechanisms in those designs and to specify an improved receiver assembly for a handgun, as well as a handgun equipped with the receiver assembly.

This object is achieved by the features according to the claims.

A receiver assembly for a handgun is formed according to the invention. The receiver assembly comprises:

- a receiver with a magazine well;
- a locking device, the locking device being received in a locking device receptacle of the receiver, wherein the locking device comprises a locking lever for actuating the locking device;
- a control block, wherein the control block is received in a control block receptacle of the receiver;
- a trigger, wherein the trigger is pivotably received in the receiver by means of a trigger axis;
- a sear bar, the sear bar being coupled to the trigger and extending to the control block, wherein the sear bar has a guide bracket;
- a locking bar, the locking bar interacting with the locking device and being displaceable between a rest position and an actuating position wherein the receiver assembly is configured to accommodate a slide assembly.

Furthermore, a lowering component is received in the control block, wherein the lowering component is displaceable relative to the receiver between a locking position and an unlocking position for removing the slide assembly from the receiver assembly, wherein the lowering component has a control window, wherein the guide bracket of the sear bar is guided in the control window, wherein the lowering component has a guide link, wherein a guide lug of the locking bar protrudes into the guide link, wherein the guide lug protrudes through a bar guide slot formed in the control block.

The receiver assembly according to the invention has the advantage that it provides an alternative method for disassembling the handgun. A slide assembly placed on the receiver assembly can thus be easily removed from the receiver assembly. The construction and structure of the receiver assembly according to the invention make it possible to achieve an alternative method for removing the slide assembly from the receiver assembly that is robust and has the goal of achieving the best possible retention of function even after the handgun has been used for many years.

Furthermore, it can be provided that the guide link is V-shaped. In particular, it can be provided that the guide link has a guide link main part and a guide link secondary part, which are arranged in a V-shape at an angle to one another. In addition, it can be provided that the guide link main part is arranged at an angle to an upper edge of the control window.

Furthermore, it can be expedient if the lowering component is designed as a single piece. In particular, it can be provided that the lowering component is designed as a single piece, as a sheet metal component, in particular as a stamped part, though also other manufacturing techniques such as 3D-printing can be imagined. This has the advantage that the lowering component can have a robust construction. Furthermore, the lowering component can be efficiently produced by this measure.

Furthermore, it can be provided that the lowering component has a first lowering component wing and a second lowering component wing, the first lowering component wing and the second lowering component wing being coupled to one another by means of a base, wherein the control window and the guide link are designed as a recess in the first lowering component wing. This has the advantage that the lowering component can be guided well in the control block.

In particular, it can be provided that the first lowering component wing and the second lowering component wing are arranged at an angle of 90° with respect to the base. In other words, the first lowering component wing and the second lowering component wing may be formed in a U-shape together with the base. The first lowering component wing and the second lowering component wing may be arranged in parallel with one another. As a result of this measure, the lowering component can be efficiently manufactured and, moreover, have a robust construction.

In addition, it can be provided that an abutment for a lowering component return spring is formed on the base. This has the advantage that the lowering component can be compelled into an unlocking position by the lowering component return spring. Of course, it is also conceivable that the abutment for a lowering component return spring is arranged at another point on the lowering component.

Furthermore, it can be provided that the abutment is designed as a bracket which is arranged at an angle of 90° to the base. It is particularly efficient to manufacture an abutment designed in this way.

In addition, it is conceivable that a guide elevation for positioning or guiding the lowering component return spring is formed in the abutment. Furthermore, it can be provided that the guide elevation is designed as a stamped and bent part.

An embodiment according to which it can be provided that a first wing extension is formed on the first lowering component wing and that a second wing extension is formed on the second lowering component wing is also advantageous, wherein the first wing extension protrudes laterally towards the outside with respect to the first lowering component wing, and the second wing extension protrudes laterally towards the outside with respect to the second lowering component wing, wherein the first wing extension is designed to be guided in a first guide groove of a slide, and the second wing extension is designed to be guided in a second guide groove of the slide. This measure enables the lowering component to be locked in its locking position. In a further embodiment variant, it is also conceivable that only on the first lowering component wing is a first wing extension formed, the first wing extension protruding laterally towards the outside with respect to the first lowering component wing, wherein the first wing extension is designed to be guided in a first guide groove of a slide.

According to a development, it is possible that a first pressure surface is formed on the first wing extension, which is designed to rest against a first pressure bevel of a first recess of the first guide groove, and that a second pressure surface is formed on the second wing extension, which is designed to rest against a second pressure bevel of a second recess of the second guide groove. As a result of this measure, when the handgun is disassembled, a further lowering of the lowering component can be achieved, which results in an alternative disassembly process. Of course, a first pressure surface can also be formed only on the first wing extension.

Furthermore, it can be provided that a first contact surface is formed on the first wing extension, which is designed to rest on an underside of the slide, and that a second contact surface is formed on the second wing extension, which is designed to rest on an underside of the slide. In particular, it can be provided that the first contact surface is formed at a first angle to the first pressure surface. Furthermore, it can be provided that the second contact surface is formed at a second angle to the second pressure surface. Of course, a first contact surface can also be formed only on the first wing extension.

Furthermore, it can be useful if a linear guide slot is formed in the control block, the first wing extension being guided in the linear guide slot. This measure enables the lowering component to be additionally guided in the control block.

In particular, it can be provided that the linear guide slot and the bar guide slot of the control block are arranged at an angle to one another.

In addition, it can be provided that an ejector is formed on the lowering component. This has the advantage that, together with the control window and thus with the sear bar, the ejector can also be lowered at the same time. As a result, all of the components of the receiver assembly that protrude into the slide assembly can be lowered, which allows the slide assembly to move forward on the receiver assembly without obstruction, and thus be separated from the receiver assembly.

In particular, it can be provided that the ejector is arranged on the first lowering component wing.

Furthermore, it can be provided that the locking bar is guided past the magazine well on a first side, and that the sear bar is guided past the magazine well on a second side. This has the advantage that the magazine can be accommodated between the locking bar and the sear bar, so that the space available within the receiver can be used effectively.

Furthermore, it can be provided that the locking bar is designed as a formed sheet metal part, in particular as a stamped part.

According to a particular embodiment, it is possible for the locking bar to have a blocking element which is designed to block a displacement of the locking bar when a magazine is present in the magazine well. This has the advantage that by means of this measure the locking bar can only be transferred from its rest position to its actuating position when there is no magazine in the magazine well.

Furthermore, it can be provided that the blocking element is designed in the form of a kink of the locking bar, wherein a contact bevel is formed in the magazine, on which contact bevel the locking bar comes to rest in the region of the kink when an attempt is made to move the locking bar into an actuating position.

In an alternative embodiment variant, it can be provided that the blocking element is designed in the form of a bracket on the locking bar. The bracket can be bent in the direction of the magazine well and come into contact with the magazine when an attempt is made to move the locking bar into an actuating position.

According to an advantageous development, it can be provided that the locking device comprises a locking slider which is coupled to the locking lever, wherein an actuating surface is formed on the locking bar, which actuating surface serves for contact with the locking slide, wherein the actuating surface is arranged at an angle to a receiving slot. A locking slider of this type can have a robust structure, which has the goal of achieving the best possible retention of function over many years of use.

Furthermore, it can be provided that the locking slider has an actuating part and a retaining part. The retaining part can have a holding lug which is designed to stop the slide. The retaining part can be displaceable relative to the actuating part. The actuating part can protrude into a recess in the locking lever and thereby be displaceable by means of the locking lever. It can also be provided that the retaining part is biased into a retaining position by means of a locking spring. As such, the slide can be pushed onto the receiver without the locking lever having to be moved from its base position to its open position.

In an alternative embodiment variant, it can be provided that the locking slider is designed as a single piece. It can also be provided in this case that the locking slider has a retaining lug which is designed to stop the slide. Furthermore, it can be provided that the locking slider protrudes into a recess in the locking lever. The recess in the locking lever can be of such a length that the locking slider can be moved from a retaining position into a release position without the locking lever being moved from its base position to its open position. As such, the slide can be pushed onto the receiver without the locking lever having to be moved from its base position to its open position.

In a further alternative variant, it can be provided that the locking lever is coupled to a locking shaft, the retaining lug being formed on the locking shaft. Due to the coupling, the rotational movement of the locking shaft can serve directly to pivot the retaining lug out of the retaining position into a release position.

In particular, it can be provided that the actuating part and the retaining part are each designed as formed sheet metal parts, in particular as stamped parts.

In particular, it can be advantageous if a groove is formed in the trigger axis, wherein a recess is formed in the locking bar, wherein the locking bar in its rest position engages in the groove and the locking bar in its actuating position releases the trigger axis in the region of the recess for axial displacement. By this measure, the trigger axis can be secured against falling out when the locking bar is in its rest position. Furthermore, the trigger axis can be released for axial removal when the locking bar is in its actuating position.

The advantages mentioned at the outset can be achieved by means of a lowering component designed in this way.

A handgun is formed according to the invention. The handgun includes:

a receiver assembly;

a slide assembly, the slide assembly being received on the receiver assembly.

The receiver assembly is designed according to one of the above features.

A handgun designed in this way has the advantages mentioned above.

Furthermore, it can be provided that the slide assembly comprises a slide, wherein the slide has a first guide groove which is designed to guide the slide on the receiver assembly, wherein a first recess is formed in the first guide groove, and particularly that a first pressure bevel is formed on the first recess. A slide designed in this way can, in conjunction with the receiver assembly according to the invention, provide an alternative method for disassembling the handgun.

An embodiment according to which it can be provided that the slide assembly comprises a slide, the slide having a first guide groove and a second guide groove, which are designed to guide the slide in the receiver assembly, wherein a first recess is designed in the first guide groove, in particular that a first pressure bevel is formed adjoining the first recess, wherein a second recess is formed in the second guide groove, in particular that a second pressure bevel is formed adjoining the second recess, is also advantageous. A slide designed in this way can, in conjunction with the receiver assembly according to the invention, provide an alternative method for disassembling the handgun.

A slide in the sense of this document is also sometimes referred to as an upper. In addition to the actual slide, the slide assembly also includes components attached to it.

For a better understanding of the invention, it is explained in more detail with reference to the following figures.

BRIEF DESCRIPTION OF THE DRAWINGS

They each show a greatly simplified schematic illustration:

FIG. 15 is a schematic illustration of a third step for disassembling the handgun;

DETAILED DESCRIPTION

By way of introduction, it should be noted that in the differently described embodiments, the same parts are provided with the same reference symbols or the same component names, and the disclosures contained in the entire description can be transferred accordingly to the same parts with the same reference symbols or the same component names.

Figure 1:
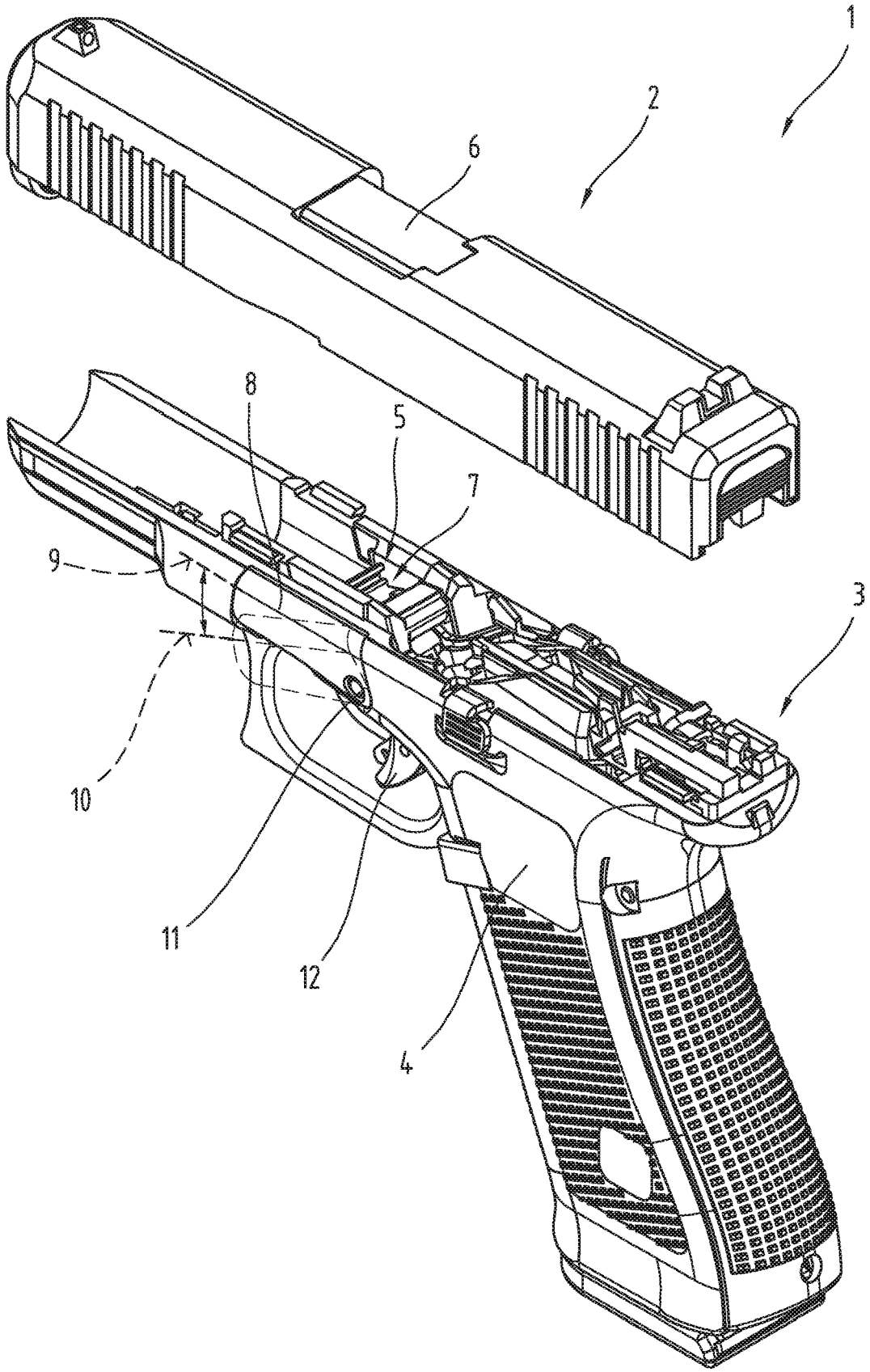
FIG. 1 is an exploded view of a first embodiment of a handgun in a perspective view.

FIG. 1 shows in a perspective view an exploded view of a first embodiment of a handgun 1.

As can be seen from FIG. 1, it can be provided that the handgun 1 comprises a slide assembly 2. It can also be provided that the handgun 1 comprises a receiver assembly 3. The slide assembly 2 and the receiver assembly 3 are shown spaced apart from one another in the illustration according to FIG. 1.

In particular, it can be provided that, in the state of use of the handgun 1, the slide assembly 2 is coupled to the receiver assembly 3.

The receiver assembly 3 can comprise a receiver 4. Furthermore, it can be provided that the receiver assembly 3 comprises a locking device 5. The locking device 5 can be used to catch or limit the movement of the slide assembly 2 relative to the receiver assembly 3. In particular, it can be provided that the locking device 5 cooperates with a barrel 6 of the slide assembly 2.

In particular, it can be provided that in the receiver 4, a locking device receptacle 7 is formed in which the locking device 5 can be accommodated.

As can also be seen from FIG. 1, it can be provided that the locking device 5 comprises a locking lever 8.

In the illustration according to FIG. 1, the locking lever 8 is in a base position 9. The locking lever 8 can be received on the receiver 4 in such a manner that it can be pivoted manually and/or by the user of the handgun 1 into an open position 10.

In particular, it can be provided that the locking lever 8 is pivotably attached by means of a trigger axis 11 to the receiver 4. It can also be provided that a trigger 12 is pivotably attached to the receiver 4 by means of the trigger axis 11. The locking lever 8 and the trigger 12 can thus be pivoted mounted around the same trigger axis 11. The trigger 12 can also be referred to by the term trigger lever.

Figure 2:
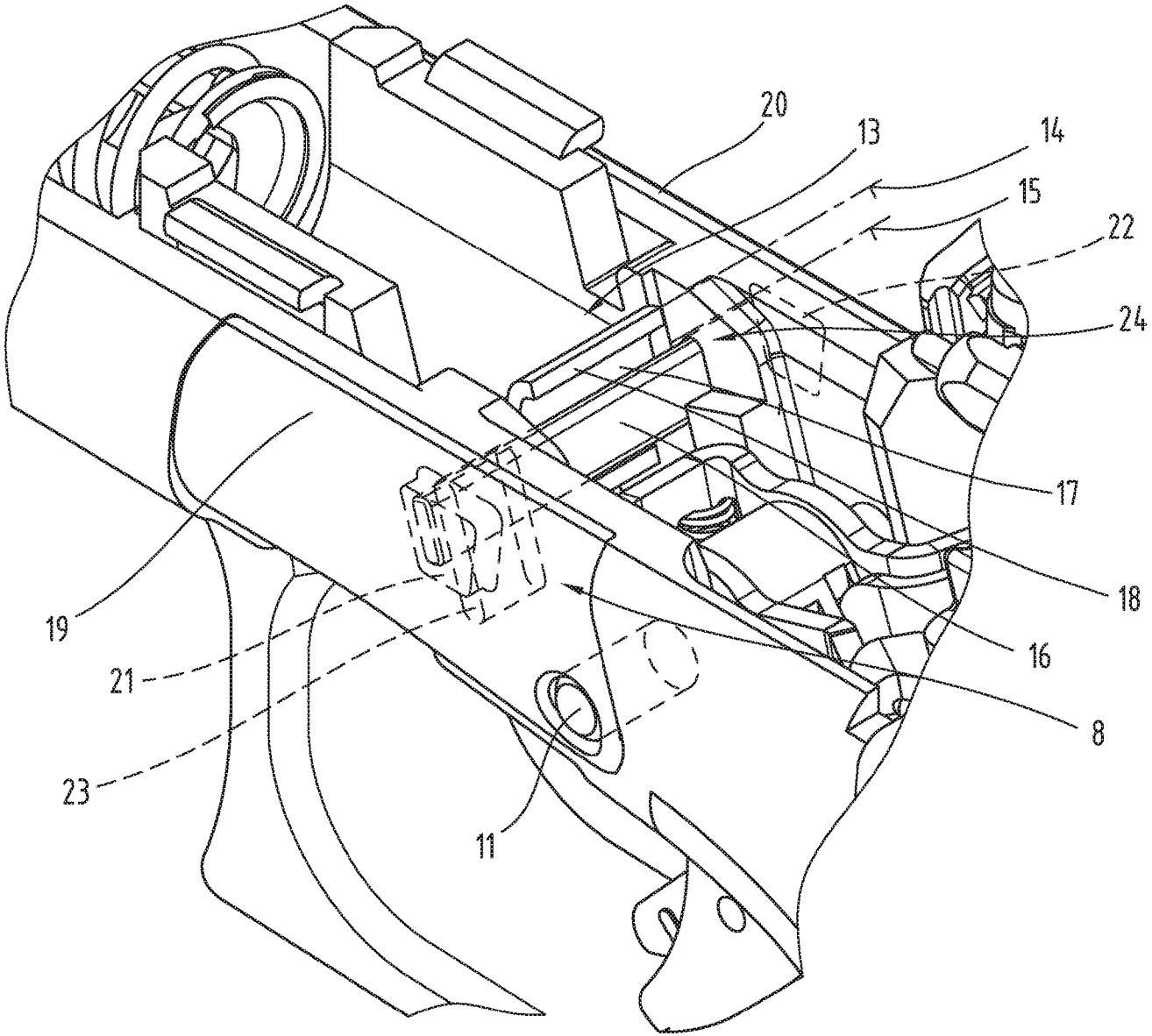
FIG. 2 is a detailed illustration of the first embodiment of the handgun in a perspective view.

FIG. 2 shows a perspective view of a first embodiment of the locking device 5, wherein the same reference numerals or component designations as those of the previous FIG. 1 are used here again for the same parts. In order to avoid unnecessary repetition, reference is made to the detailed description in the preceding FIG. 1.

As can be seen from FIG. 2, it can be provided that a locking slider 13 is formed which, by means of the locking lever 8, can be moved between a retaining position 14 and a release position 15.

In particular, it can be provided that the locking slider 13 comprises an actuating part 16 and a retaining part 17. The actuating part 16 and the retaining part 17 can be designed as structurally independent components which can be displaced relative to one another.

In particular, it can be provided that a retaining lug 18 is formed on the retaining part 17, which serves the function of interacting with a corresponding counter element on the slide assembly 2, in particular on the barrel 6.

Furthermore, it can be provided that the actuating part 16 has an elongated extension and extends between a first lever part 19 and a second lever part 20 of the locking lever 8. The locking lever 8 can be designed as an injection molded part, wherein the first lever part 19 and the second lever part 20 of the locking lever 8 can be coupled to one another as a single piece. Furthermore, it is also conceivable that the first lever part 19 and the second lever part 20 of the locking lever 8 are each designed as structurally independent components which are coupled to one another.

In particular, it can be provided that one recess 21, 22 is formed in each of the two lever parts 19, 20 of the locking lever 8, serving to receive the actuating part 16. The first recess 21 can be arranged in this case in the first lever part 19 of the locking lever 8, and the second recess 22 can be arranged in the second lever part 20 of the locking lever 8.

Due to the positive fit of the actuating part 16 in the recess 21, a movement coupling between the locking lever 8 and the actuating part 16 can be achieved. In particular, it can be provided that the recess 21 is designed such that when the locking lever 8 is rotated between the base position 9 and the open position 10, the actuating part 16 can be guided into the recesses 21, 22.

Furthermore, it can be provided that a first receiving slot 23 and a second receiving slot 24 are formed in the receiver 4, in which the actuating part 16 is received in a linearly displaceable manner.

As can also be seen from FIG. 2, it can be provided that the retaining part 17 has a smaller extension in a transverse direction of the handgun 1 than the actuating part 16. In particular, it can be provided that the retaining part 17 is accommodated inside the receiver 4 between the two recesses 21, 22. Furthermore, it can be provided that the retaining part 17 has a rounded shape.

Figure 3:
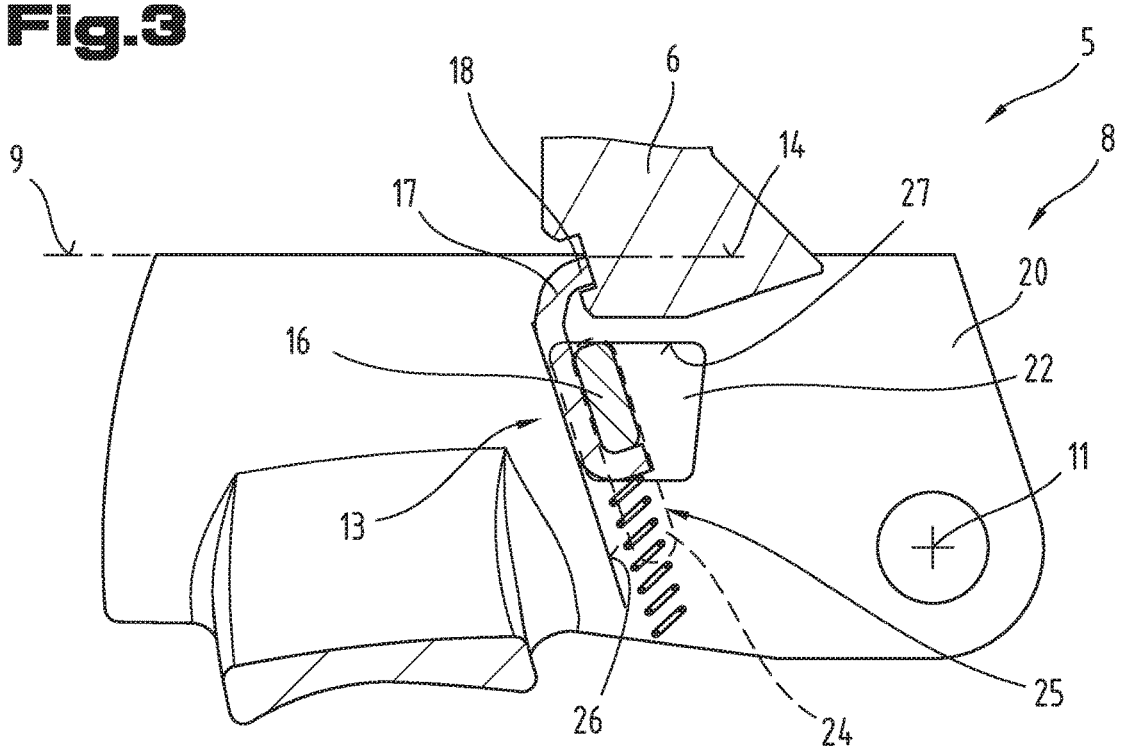
FIG. 3 is a schematic illustration of a first embodiment of a locking device in a first position.
Figure 4:
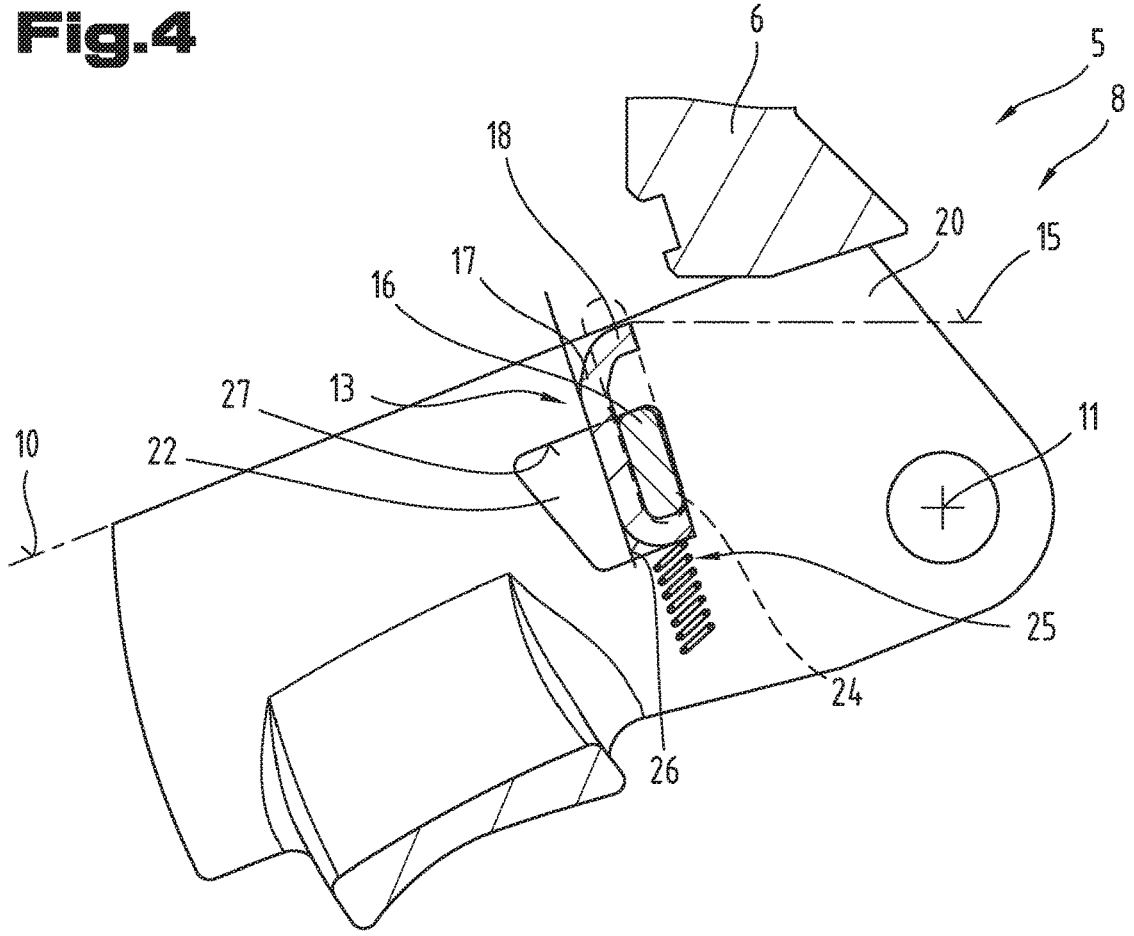
FIG. 4 is a schematic illustration of the first embodiment of the locking device in a second position.
Figure 5:
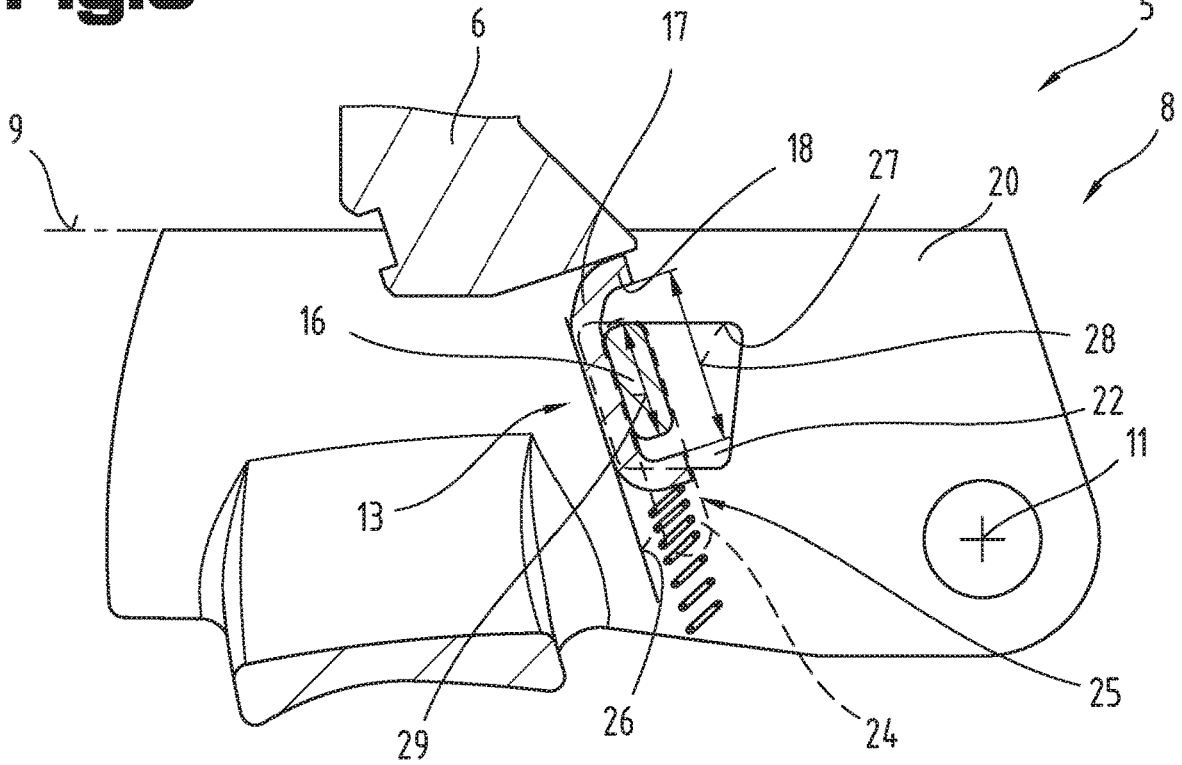
FIG. 5 is a schematic illustration of the first embodiment of the locking device in a third position.

Various positions of the locking device 5 are schematically shown in FIGS. 3 to 5, wherein the same reference numerals or component designations as those of the preceding FIGS. 1 and 2 are again used for the same parts. In order to avoid unnecessary repetition, reference is made to the detailed description in the preceding FIGS. 1 and 2.

The function of the locking device 5 is illustrated in FIGS. 3 to 5.

FIG. 3 shows a first position of the locking device 5. The locking lever 8 is located in its base position 9 in this case. Because of the sectional view, only the second lever part 20 is visible.

The retaining part 17 of the locking slider 13 is in its retaining position 14. This is achieved by the retaining part 17 being compelled into this retaining position 14 by means of a locking spring 25.

In particular, the retaining part 17 can be designed in a C shape, wherein the actuating part 16 can be accommodated between the two legs of the C shape. In the retaining position 14, the retaining part 17 can preferably be in contact with the actuating part 16, in particular on a lower leg of the C shape, and thus held in position. Furthermore, the retaining part 17 can be in contact with a guide surface 26, wherein the guide surface 26 can be formed in the receiver 4. The guide surface 26 is only indicated schematically.

As such, the retaining part 17 can be accommodated in a form-fitting manner between the guide surface 26 of the receiver 4 and the actuating part 16.

As can be clearly seen from FIG. 3, the actuating part 16 in this case can be guided in the receiving slots 23, 24. Furthermore, the recesses 21, 22 each have a recess upper edge 27. The upper edge 27 of the recesses 21, 22 can be used for contacting the actuating part 16. Seen in cross section, the actuating part 16 can have a rounded shape in order to fit well into the C shape of the retaining part 17. In addition, the rounded shape enables the actuating part 16 to rest properly on the recess upper edge 27 of the recesses 21, 22.

In the position shown in FIG. 3, the retaining part 17 is thus compelled upwards by means of the locking spring 25. As a result, the actuating part 16, which is in contact with the retaining part 17, is also pushed upwards. As a result, the locking lever 8, which with its recess upper edge 27 lies on the actuating part 16, is also pushed upwards.

The locking lever 8 can be used to separate the slide assembly 2 from the receiver assembly 3, by the user moving it from its base position 9 into the open position 10. The following steps are carried out in such a case.

The locking lever 8 is rotated about the trigger axis 11, making the position of the recesses 21, 22 move down. The actuating part 16, which is in contact with the recess upper edge 27, is also pushed down in this case by the guide in the receiving slots 23, 24, providing it with linear guidance. The retaining part 17, which positively surrounds the actuating part 16 and lies on it, is also pressed downwards in this case. As a result, the retaining part 17 is guided from its retaining position 14 into its release position 15. As such, the retaining part 17, in particular the retaining lug 18, is now no longer in engagement with the corresponding counterpart of the barrel 6, such that the slide assembly 2 can be removed from the receiver assembly 3.

When performing the steps described above, the locking spring 25, which was originally under tension, will be further compressed.

Then, the locking lever 8 is released or cleared by the user, such that the force of the locking spring 25 can return the complete system to its original position, as shown and described in FIG. 3. In an alternative embodiment, it is also conceivable that the locking lever 8, in its open position 10, snaps or locks into place, and only returns back into its base position 9 after an impulse, for example a backward thrust.

FIG. 5 shows a further method step for assembling the slide assembly 2 with the receiver assembly 3. As can be seen from FIG. 5, it is not absolutely necessary during the assembly of the slide assembly 2 with the receiver assembly 3 that the locking lever 8 is moved out of its base position 9.

This can be achieved by the barrel 6, during the assembly process, moving the retaining part 17 downward against the spring force of the locking spring 25. A corresponding bevel can be formed on the barrel 6 in this case. Furthermore, a bevel and/or the C shape of the retaining part 17 correspond to the bevel on the barrel 6, so that the slide assembly 2 being pushed onto the receiver assembly 3 results in a displacement of the retaining part 17 against the spring force of the locking spring 25, out of its retaining position 14.

Due to the structurally independent design of the retaining part 17 and the actuating part 16, the retaining part 17 can be moved downwards without the actuating part 16, and the locking lever 8 connected to it, being moved. In particular, this can be achieved by the C-shaped form of the retaining part 17, and by the actuating part 16 being embedded therein.

In particular, it can be provided that the retaining part 17 has an open portion extension 28. Furthermore, the actuating part 16 can have a height 29. In particular, it can be provided that the height 29 of the actuating part 16 is smaller than the open portion extension 28 of the retaining part 17.

In particular, it can be provided that the height 29 of the actuating part 16 is smaller, at least by a distance between the retaining position 14 and the release position 15, than the open portion extension 28 of the retaining part 17.

If at this point during the assembly process, the slide assembly 2, in particular the barrel 6, is pushed far enough onto the receiver assembly 3 and is at least in a position as shown in FIG. 3, the retaining part 17 can be pushed by the spring force of the locking spring 25 back to its retaining position 14, and/or be compelled into the same. This allows the slide assembly 2 to be secured on the receiver assembly 3.

Furthermore, it can be provided that the locking lever 8 has latching projections or latching elements, so that it remains in its base position 9 during the assembly process, as shown in FIG. 5. These latching elements can be triggered with a low actuating force when the user rotates the locking lever 8.

Figure 6:
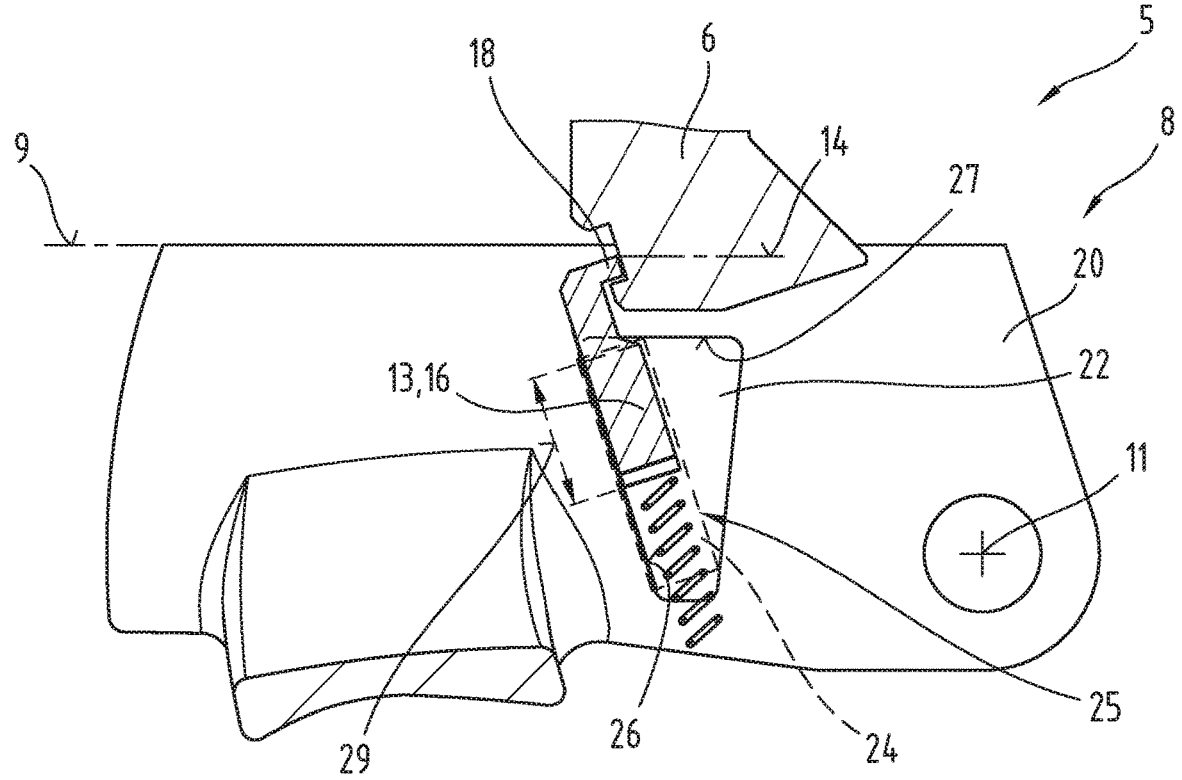
FIG. 6 is a schematic illustration of a second embodiment of the locking device in a first position.

In FIG. 6 is an alternative embodiment of the locking device 5, wherein the same reference numerals or component designations as those in the preceding FIGS. 1 to 5 are used for the same parts. In order to avoid unnecessary repetition, reference is made to the detailed description in the preceding FIGS. 1 to 5.

As can be seen from FIG. 6, it can be provided that the locking slider 13 is formed as a single piece. Thus, the retaining lug 18 can be formed directly on the portion which is guided in the recesses 21, 22. In particular, it can be provided in this case that the retaining lug 18 does not extend across the entire width of the locking slider 13, and rather the retaining lug 18 is formed only in a central region, so that a corresponding accommodation of the locking slider 13 in the receiving slots 23, 24 is made possible.

An actuation of the locking slider 13 or a transfer of the locking slider 13 from its retaining position 14 into the release position 15 of the embodiment described in FIG. 6 takes place mutatis mutandis as in the description of FIG. 4, by rotating the locking lever 8.

In the embodiment of the locking device 5 according to FIG. 6, the slide assembly 2 is joined with the receiver assembly 3 as follows.

Due to corresponding bevels on the barrel 6, the locking slider 13 is pressed out of its retaining position 14 and downwards. It can be provided in this case that the recesses 21, 22 in the locking lever 8 have a height that is sufficient for the locking slider 13 to glide downwards without the locking lever 8 moving out of its base position 9.

In particular, it can be provided that the height 29 of the actuating part 16 is smaller at least by a distance between the retaining position 14 and the release position 15 than the height of the recesses 21, 22.

Figure 7:
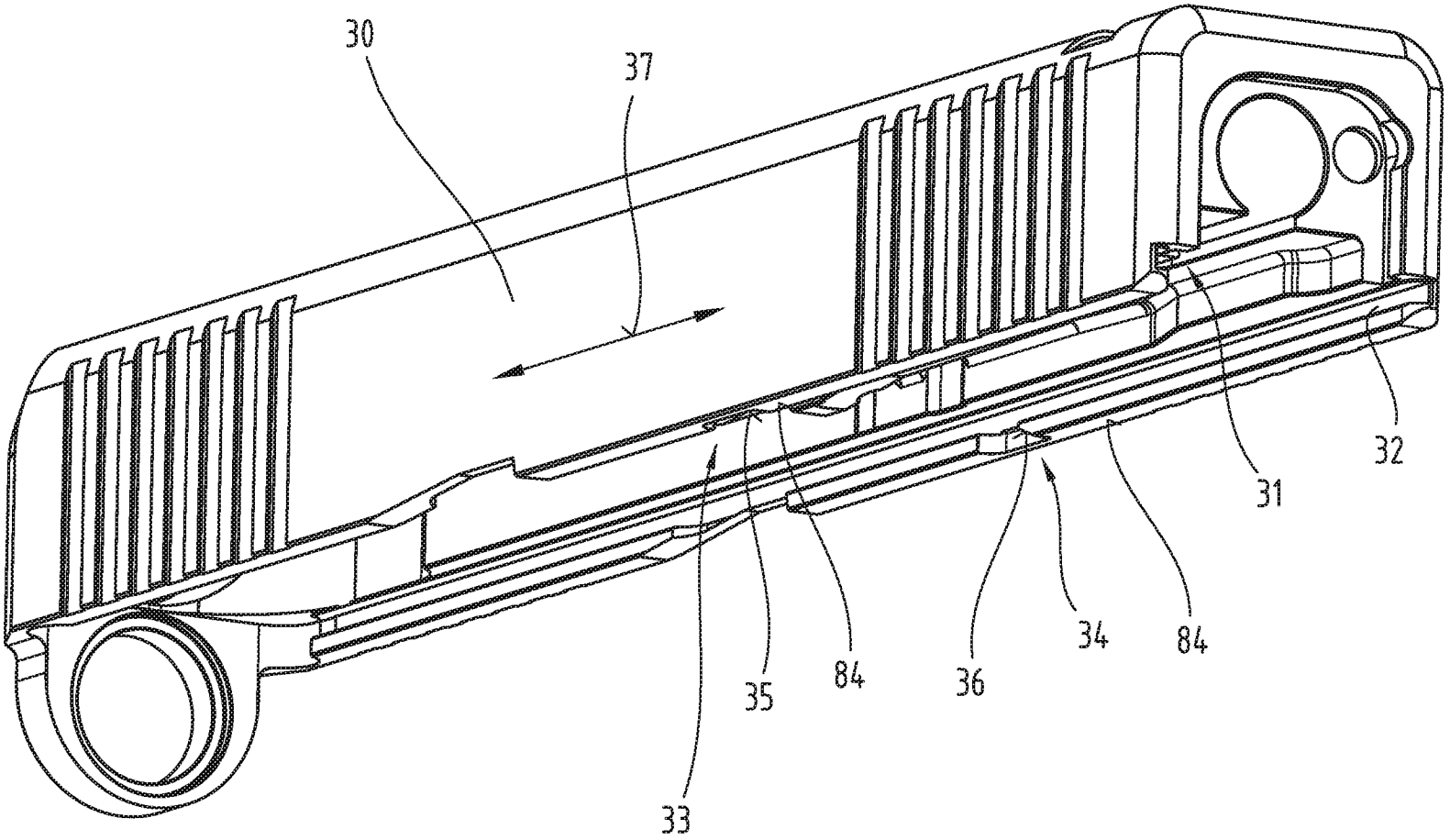
FIG. 7 is a perspective view of a slide of a slide assembly of the handgun.

FIG. 7 shows a perspective view of a slide 30 which can be included in the slide assembly 2, wherein the same reference numerals or component designations are used for the same parts as those in the preceding FIGS. 1 to 6. In order to avoid unnecessary repetition, reference is made to the detailed description in the preceding FIGS. 1 to 6.

As can be seen from FIG. 7, it can be provided that the slide 30 has a first guide groove 31 and a second guide groove 32. By means of the guide grooves 31, 32, the slide 30 can be moved in a slide displacement direction 37 relative to the receiver assembly 3.

The guide grooves 31, 32 can correspond to corresponding counter elements of the receiver assembly 3 in order to achieve a guidance of the slide assembly 2 on the receiver assembly 3. Furthermore, it can be provided that a first recess 33 is formed in the first guide groove 31. The first recess 33 can comprise a first pressure bevel 35. Analogously, it can be provided that a second recess 34 is formed in the second guide groove 32. The second recess 34 can have a second pressure bevel 36.

In particular, it can be provided that the first pressure bevel 35 and the second pressure bevel 36 are arranged at an acute angle to the slide displacement direction 37 or to the underside 84 of the slide 30. In particular, it can be provided that the recesses 33, 34 each extend from the guide groove 31, 32 to the underside 84 of the slide 30.

Figure 8:
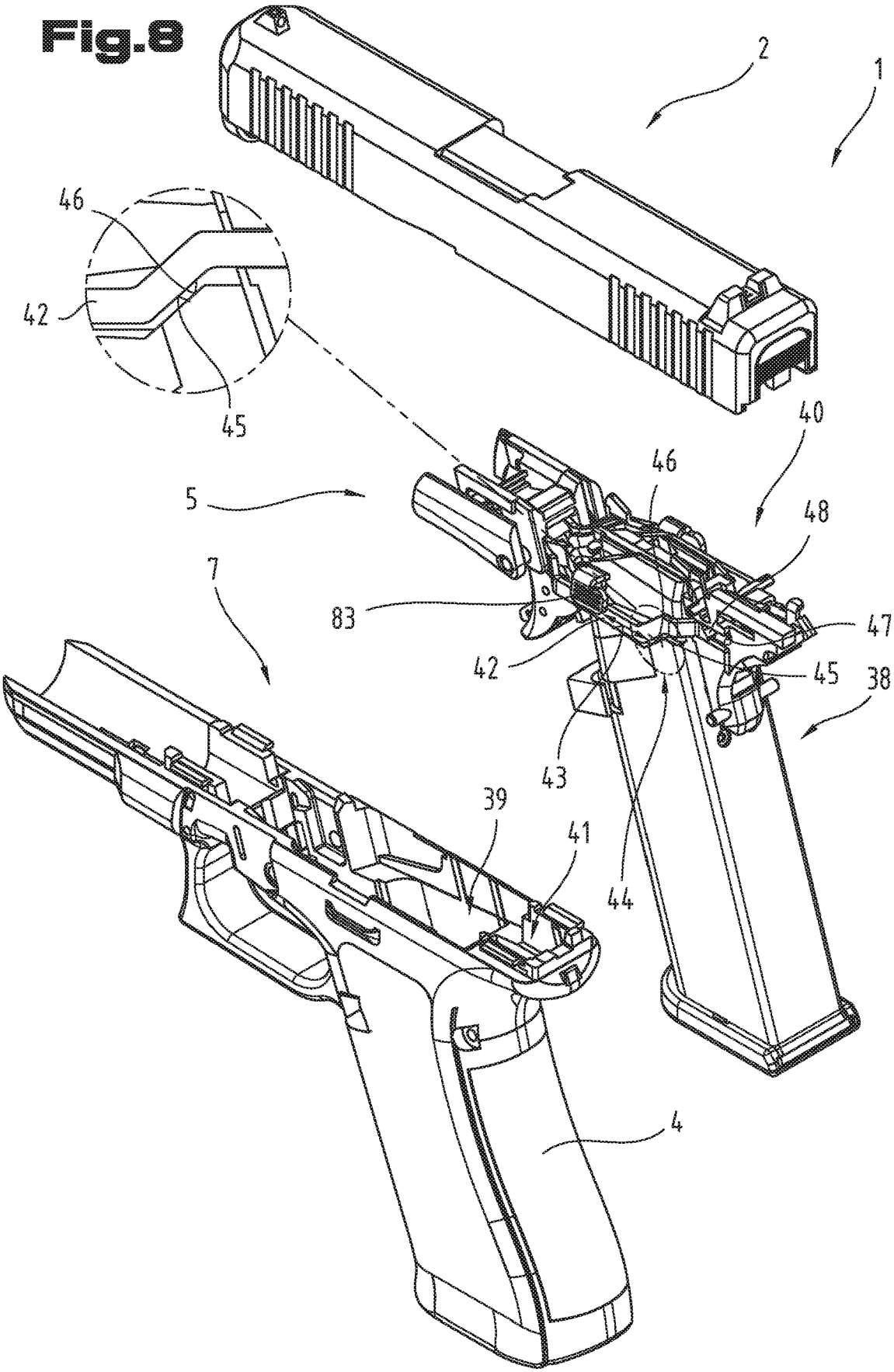
FIG. 8 is a further exploded view of the first embodiment of the handgun in a perspective view.

FIG. 8 shows a further exploded perspective view of the handgun 1, wherein the same reference numerals or component designations are used for the same parts as those in the preceding FIGS. 1 to 7. In order to avoid unnecessary repetition, reference is made to the detailed description in the preceding FIGS. 1 to 7.

In the illustration according to FIG. 8, the receiver assembly 3 is shown further disassembled, so that essential internal components of the receiver assembly 3 are visible.

As can be seen from FIG. 8, the handgun 1 can comprise a magazine 38, which can be accommodated in a magazine well 39 in the receiver 4. Furthermore, a control block 40 can be formed, which can be accommodated in a control block receptacle 41 in the receiver 4. For improved understanding, the magazine 38 is shown in its inserted position relative to the control block 40.

As can also be seen from FIG. 8, it can be provided that a locking bar 42 to which the locking device 5 can be coupled is formed. The exact function of the locking bar 42 is described below with reference to FIG. 10 and the following figures.

The locking bar 42 can be used to remove or separate the slide assembly 2 from the receiver assembly 3. In particular, it can be provided that the locking bar 42 is accommodated in the receiver 4 in a manner allowing displacement in a direction of displacement 43. In particular, it can be provided that the direction of displacement 43 of the locking bar 42 is parallel to the slide displacement direction 37.

As can be seen from FIG. 8, it can be provided that the locking bar 42 has a blocking element 44, which can serve to prevent the displacement of the locking bar 42 when the magazine 38 is inserted into the magazine well 39. The blocking element 44 can, for example, be designed in the form of a contact surface 45. The contact surface 45 can correspond to a counter surface 46, which is formed, for example, on the magazine 38 as shown. As such, with the magazine 38 inserted into the magazine well 39, when an attempt is made to move the locking bar 42, the contact surface 45 abuts the opposite surface 46, thereby preventing a displacement of the locking bar 42. If the magazine 38 has been removed from the magazine well 39, the locking bar 42 can be displaced.

As can also be seen from FIG. 8, it can be provided that a bar guide slot 47 is formed in the control block 40. The bar guide slot 47 can extend in the direction of displacement 43. Furthermore, it can be provided that the locking bar 42 has a guide lug 48 which is guided in the bar guide slot 47 and protrudes through the bar guide slot 47 into the interior of the control block 40. The guide lug 48 can extend in the direction transverse to the receiver assembly 3 and/or to the locking bar 42. In particular, it can be provided that the guide lug 48 is formed at an angle of 90° to a guide bar main part.

Figure 9:
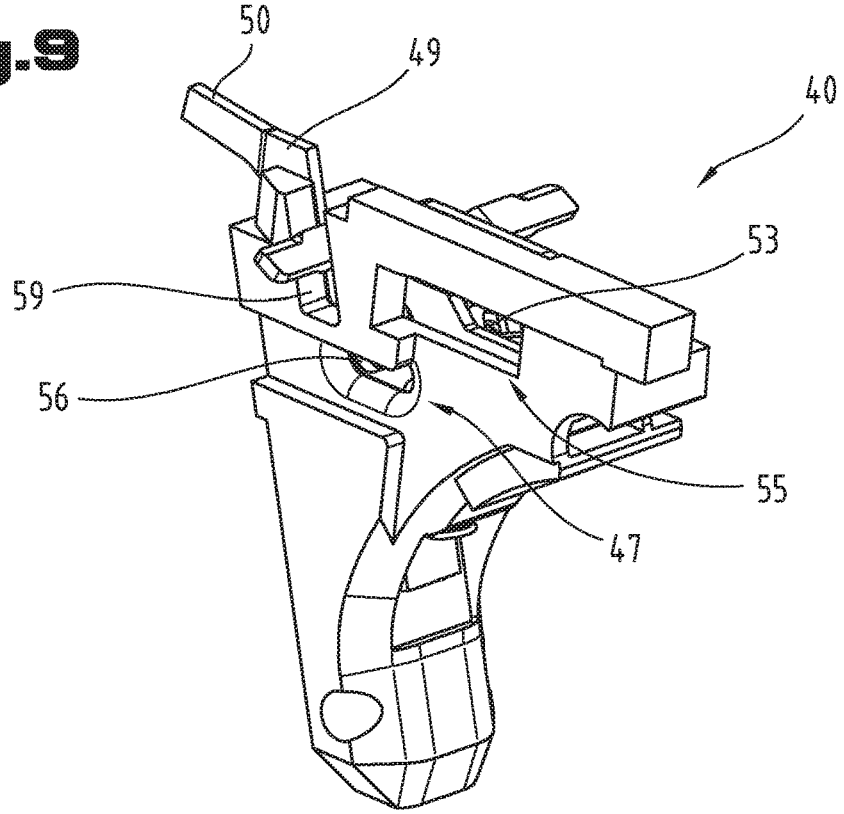
FIG. 9 is a perspective view of a control block of the handgun with a lowering component received therein.

The control block 40 is shown separately in a perspective view in FIG. 9 for better visibility. As can be seen from FIG. 9, it can be provided that a lowering component 49 is accommodated in the control block 40. The lowering component 49 can have an ejector 50 for ejecting fired cartridge casings.

Figure 10:
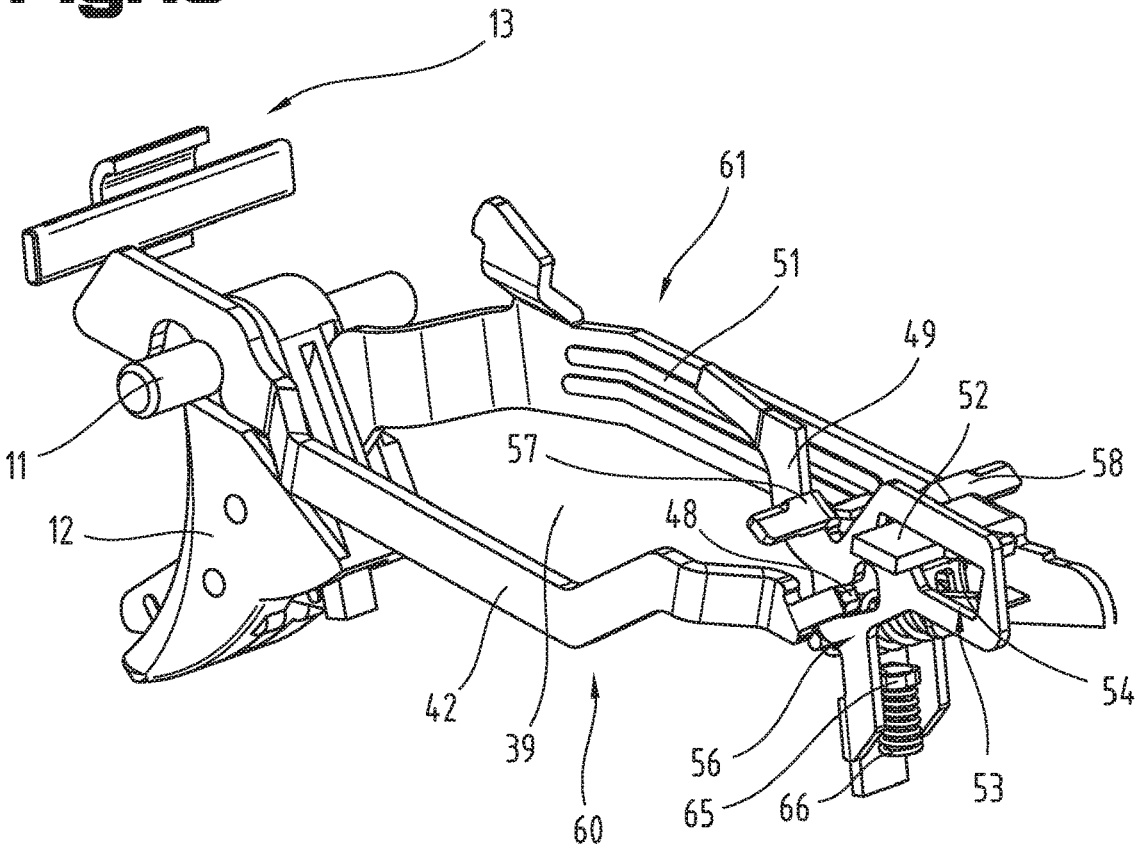
FIG. 10 is a perspective view of the lowering component, with components coupled thereto.

FIG. 10 shows further components of the receiver assembly 3 in a perspective view, with the control block 40 hidden in this case for the sake of clarity.

Figure 11:
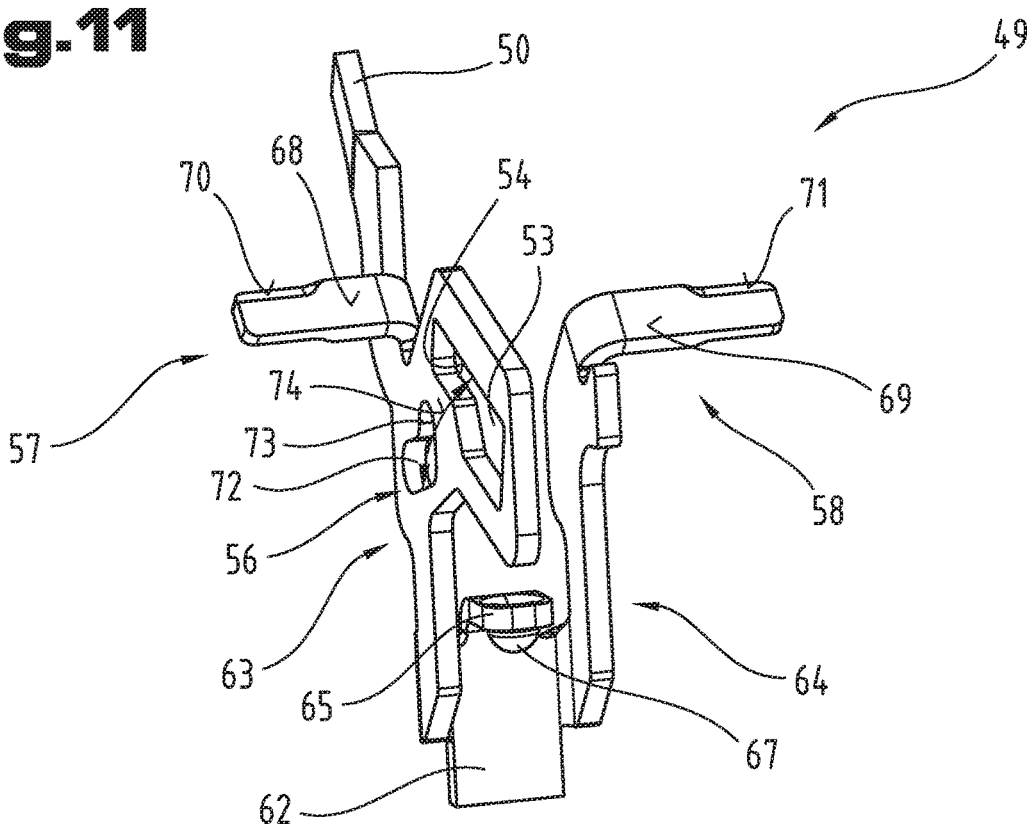
FIG. 11 is a perspective view of the lowering component.

FIG. 11 shows a perspective view of the lowering component 49.

With regard to the description of the function of the handgun 1, reference is made here to a synopsis of FIGS. 1 to 11.

As can be seen particularly well from FIG. 10, it can be provided that the receiver assembly 3 has a sear bar 51 which can be coupled to the trigger 12. The sear bar 51 can have a guide bracket 52. The guide bracket 52 can be guided in a control window 53. The control window 53 can be formed in this case in the lowering component 49. The sear bar 51 can be guided via the guide bracket 52 in the control window 53, which can open its vertical diameter as depicted in FIG. 10. This allows for lowering the guide bracket 52 and thus the sear bar 51 inside the control window 53 at a distinct position when the trigger 12 is actuated. A rod-like movement of the sear bar 51, when the trigger 12 is actuated, is brought about by the stop of a connector protrusion on the connector of the firearm. This sequence of movements is widely known to a person skilled in the art, which is why a detailed explanation is dispensed with here. The control window 53 can however be formed directly in the control block 40.

In particular, it can be provided that, in a state of rest, as shown in FIG. 10, the guide bracket 52 is in contact with an upper edge 54 of the control window 53. The control window 53 can be designed stepped.

Furthermore, a control block recess 55 can be formed in the control block 40, which can be arranged in an extension of the control window 53. In particular, it can be provided that the guide bracket 52 of the sear bar 51 protrudes through the control window 53 into the control block recess 55.

Furthermore, it can be provided that the lowering component 49 has a guide link 56. The guide lug 48 of the locking bar 42 can protrude through the bar guide slot 47 of the control block 40 into the guide link 56. A displacement of the locking bar 42 can produce a displacement and/or a lowering of the lowering component 49 relative to the receiver 4 or relative to the control block 40.

Furthermore, it can be provided that the lowering component 49 has a first wing extension 57 and a second wing extension 58. In particular, it can be provided that the first wing extension 57 is guided in a linear guide slot 59 which is formed in the control block 40.

As can be seen from FIG. 10, it can be provided that the locking bar 42 is arranged on a first side 60 of the magazine well 39. It can also be provided that the sear bar 51 is arranged on a second side 61 of the magazine well 39.

As can be seen from FIG. 11, it can be provided that the lowering component 49 has a base 62. A first lowering component wing 63 and a second lower component wing 64 can be designed to be connected to the base 62. It can also be provided that the guide link 56 and the control window 53 are arranged in the first lowering component wing 63. In addition, the ejector 50 can also be arranged on the first lowering component wing 63.

In particular, it can be provided that the first wing extension 57 is arranged on the first lowering component wing 63. The second wing extension 58 can be arranged on the second lowering component wing 64.

Furthermore, an abutment 65 can be formed on the base 62, which can serve to support a lowering component return spring 66. The abutment 65 can be designed in the form of a bracket. The bracket can be at an angle of 90° to the base 62, and/or connected to the same. Furthermore, it can be provided that a guide elevation 67 is formed in the abutment 65, which serves the purpose of guiding the lowering component return spring 66.

As can also be seen from FIG. 11, it can be provided that a first pressure surface 68 is formed on the first wing extension 57 of the first lowering component wing 63. Furthermore, it can be provided that a second pressure surface 69 is formed on the second wing extension 58 of the second lowering component wing 64. The first pressure surface 68 can correspond to the first pressure bevel 35 of the slide 30. The second pressure surface 69 can correspond to the second pressure bevel 36 of the slide 30. Furthermore, it can be provided that a first contact surface 70 is formed on the first wing extension 57. Furthermore, it can be provided that a second contact surface 71 is formed on the second wing extension 58. The first contact surface 70 or the second contact surface 71 can, during disassembly of the handgun 1, slide off of the slide 30, in particular on the underside 84 of the slide 30.

As can also be seen from FIG. 11, it can be provided that the guide link 56 has a guide link main part 72 and a guide link secondary part 73. The guide link main part 72 can be arranged at an angle 74 with respect to the top edge 54 of the control window 53. The angle 74 can be an acute angle.

Furthermore, it can be provided that the guide link main part 72 and the guide link secondary part 73 are arranged at an angle to each other.

Figure 12:
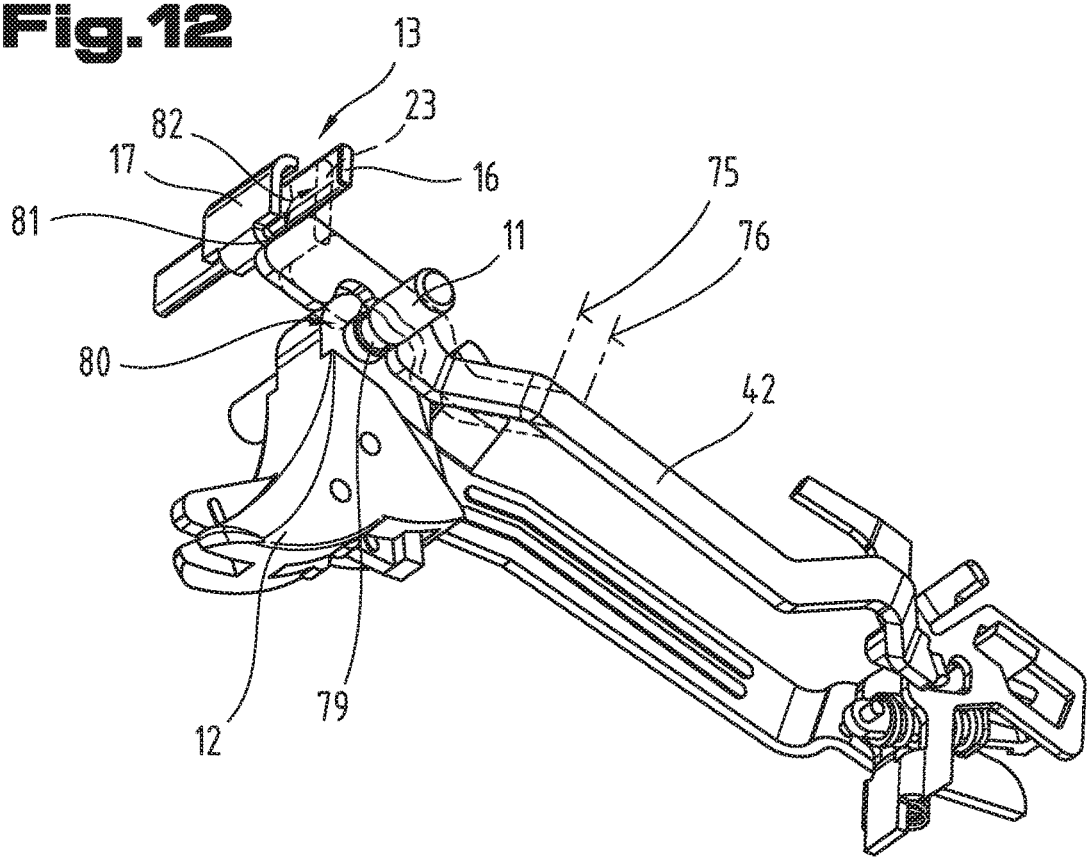
FIG. 12 is a further perspective view of the lowering component with components coupled thereto.

In FIG. 12, the components of the receiver assembly 3, which are shown in FIG. 10, are shown in a further perspective view.

As indicated schematically in FIG. 12, it can be provided that the locking bar 42 is movable between a rest position 75 and an actuating position 76. The locking bar 42 is illustrated in the rest position 75 in FIG. 12. For simplicity, the front part of the locking bar 42 is shown schematically in FIG. 12 in dashed lines, in its actuating position 76.

Because of the coupling with the locking bar 42, the lowering component 49 can be moved between a locking position 77 and an unlocking position 78.

It can also be provided that a circumferential groove 79 is formed in the trigger axis 11. Instead of the circumferential groove 79, a recess extending over a circumferential segment can also be formed. In particular, it can be provided that the locking bar 42, when it is in its rest position 75, engages in the groove 79. This enables the trigger axis 11 to be secured axially. Furthermore, it can be provided that a recess 80 is formed in the locking bar 42. The recess 80 can be designed or positioned in such a way that the locking bar 42, when it is in its actuating position 76, does not engage in the groove 79. This allows the trigger axis 11 to be released for disassembly.

As can also be seen from FIG. 12, it can be provided that the locking bar 42 has an actuating surface 81. The actuating surface 81 can be arranged on the front end of the locking bar 42. In particular, it can be provided that the actuating surface 81 of the locking bar 42 lies against the locking slider 13. In one design, with a two-part locking slider 13, the actuating surface 81 can lie against the actuating part 16 of the locking slider 13.

By moving the locking slider 13 from its retaining position 14 into its release position 15, the locking slider 13, in particular the actuating part 16, can slide on the actuating surface 81. This allows the locking bar 42 to be moved from its rest position 75 into its actuating position 76. In particular, it can be provided that the actuating surface 81 of the locking bar 42 is arranged at an angle 82 to the receiving slot 23, 24.

Figure 13:
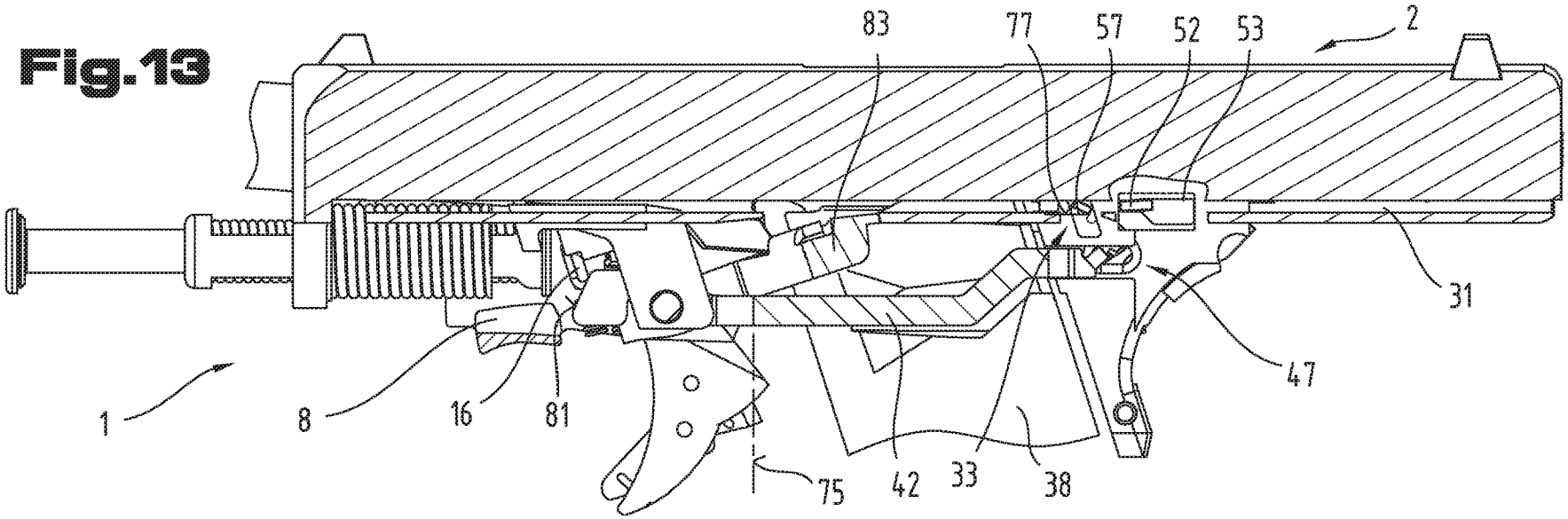
FIG. 13 is a schematic illustration of a first step for disassembling the handgun.
Figure 14:
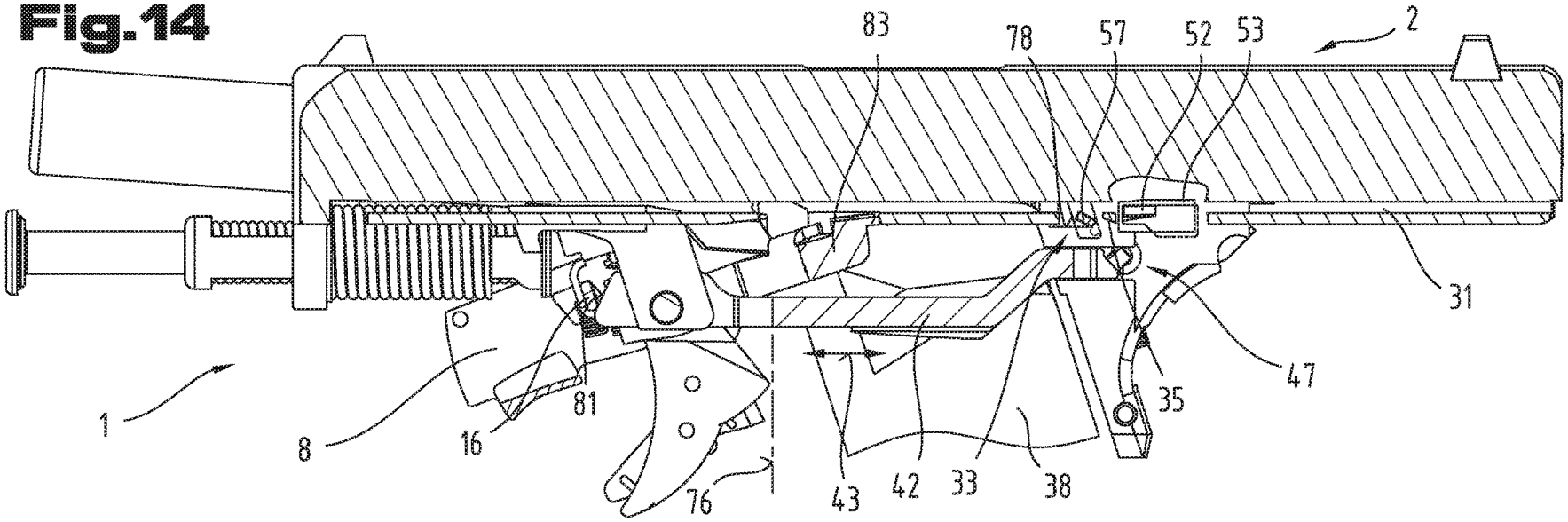
FIG. 14 is a schematic illustration of a second step for disassembling the handgun.

An unlocking process for the disassembly of the handgun 1, in particular for removing the slide assembly 2 from the receiver assembly 3, is described in individual method steps with reference to FIGS. 13 to 15, in each case when viewed together with FIGS. 1 to 12.

FIG. 13 shows a first position for the disassembly of the handgun 1. The slide assembly 2 is moved to its rear position, and can be held in this position by a slide stop lever 83. At this point at the latest, a magazine 38, which may still be situated in the magazine well 39, is removed from the magazine well 39. For the sake of clarity, the slide 30 is shown in FIG. 13 in a cutaway view in an offset partial section. In particular in the region of the control window 53, the slide 30 is shown in partial section, so that the position of the control window 53 is visible. At this point it should be noted that the first guide groove 31 is continuous in the region of the control window 53, and the interruption is due to the illustration.

In the further process step, which is shown in FIG. 14, the locking lever 8 is moved out of its base position 9 into its open position 10. As in the description of FIGS. 3 and 4, the locking slider 13, in particular the actuating part 16, is moved from the retaining position 14 into the release position 15. The contact of the actuating surface 81 on the actuating part 16 causes the locking bar 42 to move from its rest position 75 into its actuating position 76. The guidance of the locking bar 42, in particular the guide lug 48, in the bar guide slot 47, defines the path of movement of the guide lug 48. Because the guide lug 48 of the locking bar 42 at the same time engages in the guide link 56 of the lowering component 49, the lowering component 49 in this case is moved out downwards of the locking position 77 and into the unlocking position 78.

The first wing extension 57 is likewise moved downwards in this case, out of its engagement position in the first guide groove 31, through the first recess 33.

In addition, the control window 53 arranged in the lowering component 49 is likewise moved downwards. This allows the guide bracket 52 of the sear bar 51 to come into contact with the upper edge 54 of the control window 53, causing the sear bar 51 with its guide bracket 52 to also be moved downwards. The ejector 50 optionally arranged on the lowering component 49 can also be moved downwards in this case.

The displacement of the locking bar 42 in the direction of displacement 43 can only occur in a preferred embodiment if the magazine 38 is removed from the magazine well 39 and the locking bar 42 is thus released for displacement.

Proceeding from this position as shown in FIG. 14, the slide stop lever 83 can then be moved out of a slide catch position into a release position, such that the slide assembly 2 can be moved forward on the receiver assembly 3. In this case, the first pressure bevel 35 can come to rest on the first pressure surface 68. Due to the angular arrangement of the first pressure bevel 35 and/or the corresponding shape of the first pressure surface 68, the lowering component 49 can be pushed further downwards upon the further displacement of the slide assembly 2 forward. This is accompanied by all of the components and recesses located on the lowering component 49 being pushed downwards, such that the sear bar 51 is pushed further downward, and the sear bar 51 is brought outside of the path of movement of the firing pin and/or firing pin flag cooperating with the sear bar 51. The guide lug 48 of the locking bar 42 in this case is moved by the guide link main part 72 of the guide link 56 of the lowering component 49 into the guide link secondary part 73.

The first contact surface 70 can, as can be seen in FIG. 15 together with FIG. 11, come to rest on the underside 84 of the slide 30, such that the first contact surface 70 can slide on the underside 84 of the slide 30, and the lowering component 49 can therefore be held in the unlocking position 78 without actuation of the locking lever 8. The slide assembly 2 can thus be removed from the receiver assembly 3 by moving it further forward on the receiver assembly 3, since the sear bar 51 and also the ejector 50 in this case are no longer in engagement with the slide assembly 2.

Figure 16:
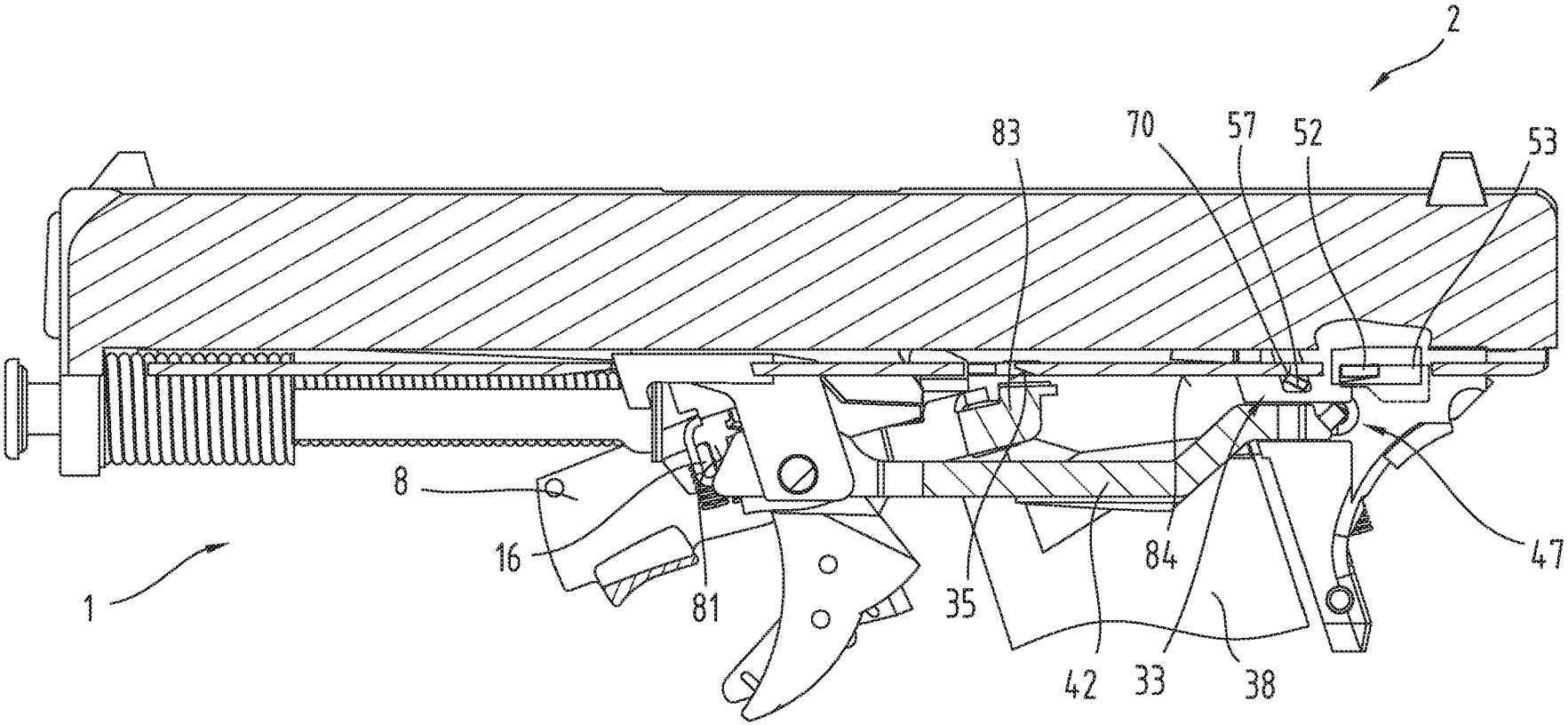
FIG. 16 is a perspective view of a further embodiment of the lowering component.
Figure 16:
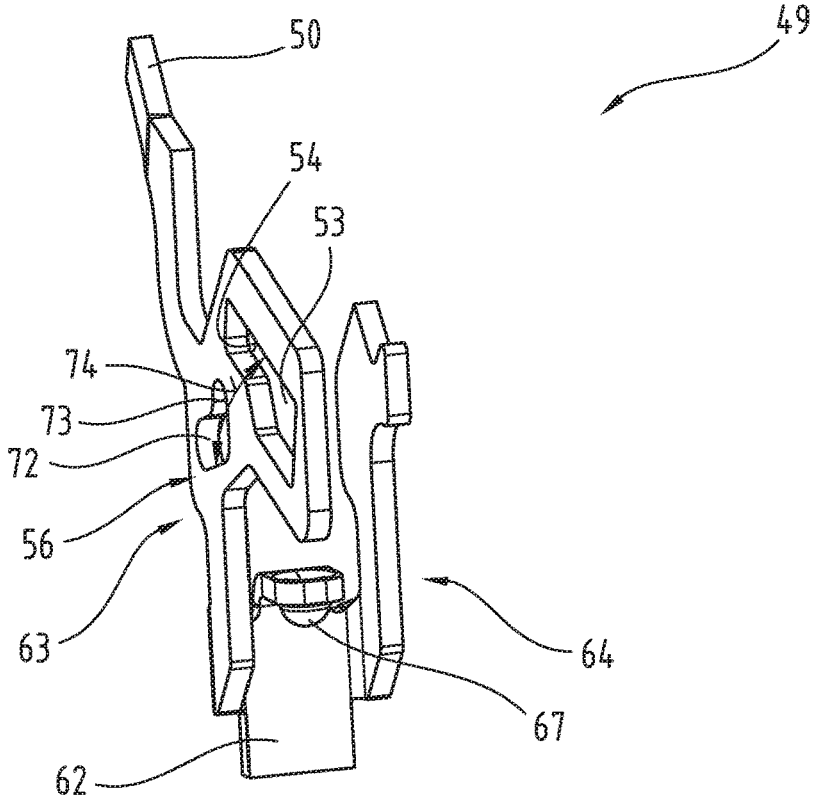

FIG. 16 shows a further embodiment of the lowering component 49, wherein the same reference numerals or component designations as in the preceding FIGS. 1 to 15 are again used for the same parts. In order to avoid unnecessary repetition, reference is made to the detailed description in the preceding FIGS. 1 to 15.

As can be seen from FIG. 16, it can be provided that the lowering component 49 has no wing extensions 57, 58.

In an alternative embodiment variant, not shown, it can also be provided that the wing extensions 57, 58 are made shorter, so that the first contact surface 70 and the second contact surface 71 are not present. In particular, the first wing extension 57 can have a length at least long enough that it can be guided into the linear guide slot 59 of the control block 40.

In a further embodiment variant, not shown, it can also be provided that the lowering component 49 has no ejector 50. The ejector 50 can be formed, as already known, for example, on the control block 40.

Figure 17:
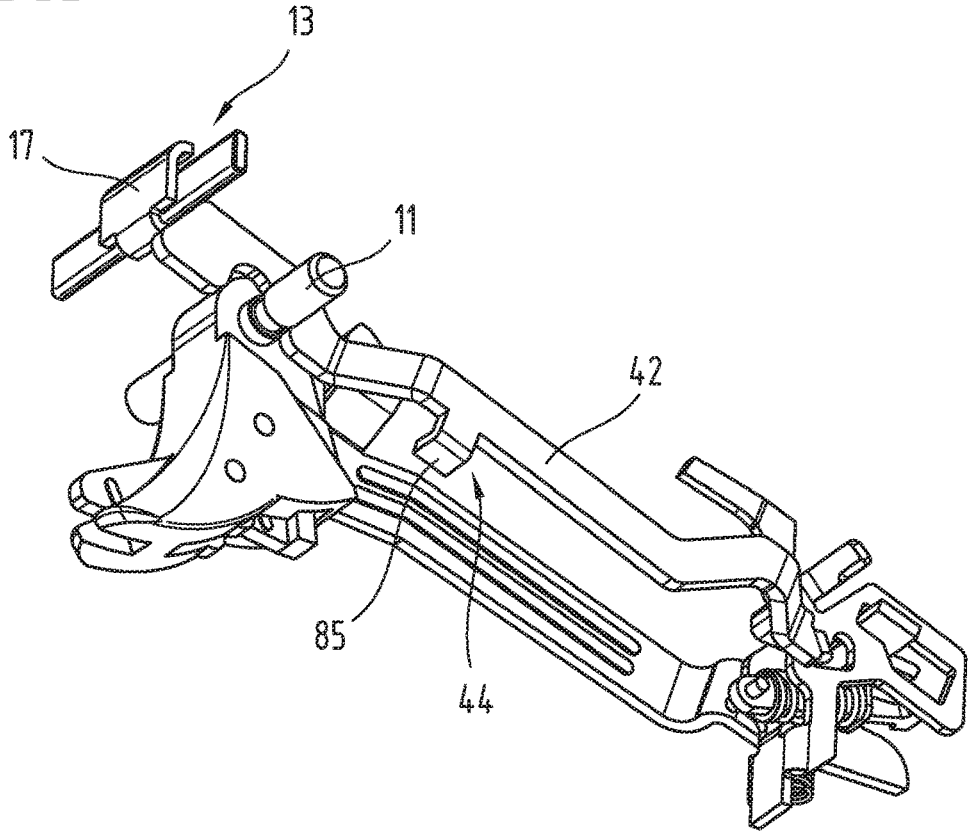
FIG. 17 is a further perspective view of the lowering component, with components coupled thereto, and a further embodiment of a locking bar.

FIG. 17 shows a further embodiment of the locking bar 42, wherein the same reference numerals or component designations as in the preceding FIGS. 1 to 15 are again used for the same parts. In order to avoid unnecessary repetition, reference is made to the detailed description in the preceding FIGS. 1 to 15.

As can be seen from FIG. 17, it can be provided that the blocking element 44 is designed in the form of a blocking tab 85. The blocking tab 85 can protrude into the magazine well 39 in such a manner that it comes to rest when a magazine 38 is inserted into the magazine well 39, if the locking bar 42 is moved in the direction of its actuating position 76.

The position details chosen in the description, such as, for example, top, bottom, side, etc., relate to the position of the handgun 1 shown in FIG. 1. The front in this case is on the left side of FIG. 1, and thus at the muzzle of the barrel 6. A longitudinal direction extends parallel to the slide displacement direction 37. A transverse extension or transverse direction extends in the width of the handgun 1 transversely to the longitudinal direction.

The embodiments show possible design variants, whereby it should be noted at this point that the invention is not limited to the specifically illustrated design variants of the same, but rather various combinations of the individual design variants with one another are possible, and this possibility of variation is based on the teaching, and technical action by the present invention lies within the ability of the skilled person working in this technical field.

The scope of protection is determined by the claims. However, the description and the drawings are to be used to interpret the claims. Individual features or combinations of features from the different embodiments shown and described can represent independent inventive solutions. The task on which the independent inventive solutions are based can be found in the description.

All information on value ranges in the present description is to be understood in such a way that it includes any and all sub-ranges thereof, e.g. the information 1 to 10 is to be understood in such a way that all sub-ranges, starting from the lower limit 1 and the upper limit 10, are also included, that is, all sub-ranges begin with a lower limit of 1 or greater and end at an upper limit of 10 or less, for example 1 to 1.7, or 3.2 to 8.1, or 5.5 to 10.

Finally, for the sake of order, it should be noted that for a better understanding of the construction, elements haven been partly shown not to scale and/or enlarged and/or made smaller.

The invention claimed is:

1. A receiver assembly for a handgun, the receiver assembly comprising:

a receiver having a magazine well;

a locking device accommodated in a locking device receptacle of the receiver, wherein the locking device comprises a locking lever for actuating the locking device;

a control block accommodated in a control block receptacle of the receiver, the control block having a bar guide slot formed therein;

a trigger that is pivotable in the receiver, wherein the trigger is pivotable about a trigger axis;

a sear bar coupled to the trigger, the sear bar extends to the control block, wherein the sear bar includes a guide bracket;

a locking bar having a guide lug, the locking bar interacts with the locking device, wherein the locking bar can be displaced between a rest position and an actuating position; and a lowering component accommodated in the control block, wherein the lowering component is displaceable, relative to the receiver, between a locking position and an unlocking position for removing a slide assembly of the handgun from the receiver assembly, the lowering component comprises:

a control window, wherein the guide bracket of the sear bar is guided in the control window; and a guide link, wherein the guide lug of the locking bar protrudes into the guide link, and wherein the guide lug protrudes through a bar guide slot formed in the control block.

2. The receiver assembly of claim 1 wherein the lowering component is formed as a single sheet metal piece.

3. The receiver assembly of claim 1 wherein the lowering component includes a first lowering component wing and a second lowering component wing, and wherein the first lowering component wing and the second lowering component wing are coupled to each other via a base, wherein the control window and the guide link are formed as a recess in the first lowering component wing.

4. The receiver assembly of claim 3 wherein the base includes an abutment formed thereon, and wherein the abutment supports a lowering component return spring.

5. The receiver assembly of claim 3 wherein the first lowering component wing includes a first wing extension formed thereon and the second lowering component wing includes a second wing extension formed thereon, wherein the first wing extension protrudes outside laterally with respect to the first lowering component wing, and wherein the second wing extension protrudes outside laterally with respect to the second lowering component wing, and wherein the first wing extension is configured to be guided in a first guide groove in a slide of the slide assembly, and wherein the second wing extension is configured to be guided in a second guide groove of the slide of the slide assembly.

6. The receiver assembly of claim 5 wherein the first wing extension includes a first pressure surface formed thereon, the first pressure surface is configured to come into contact with a first pressure bevel of a first recess of the first guide groove, and wherein the second wing extension includes a second pressure surface formed thereon, the second pressure surface is configured to come into contact with a second pressure bevel of a second recess of the second guide groove.

7. The receiver assembly of claim 5 wherein the control block includes a linear guide slot formed therein, wherein the linear guide slot is configured to guide the first wing extension.

8. The receiver assembly of claim 1 wherein the lowering component includes an ejector formed thereon.

9. The receiver assembly of claim 1 wherein the locking bar (42) is configured to be on a first side of the magazine well, and wherein the sear bar is configured to be on a second side of the magazine well.

10. The receiver assembly of claim 1 wherein the locking bar has a blocking element configured to block a displacement of the locking bar when a magazine is present in the magazine well.

11. The receiver assembly of claim 1 wherein the locking device comprises a locking slider that is coupled to the locking lever, wherein an actuating surface on the locking bar contacts the locking slider, and wherein the actuating surface is at an angle to at least one receiving slot.

12. The receiver assembly of claim 1 wherein the trigger axis includes a circumferential groove formed thereon, wherein the locking bar includes a recess (80) formed thereon, wherein the locking bar, in the rest position, engages in the circumferential groove, and wherein the locking bar, in the actuating position, releases the trigger axis in a region of the recess for axial displacement.

13. A handgun comprising:

a slide assembly; and a receiver assembly couplable to the slide assembly, the receiver assembly comprises:

a receiver having a magazine well;

a locking device accommodated in a locking device receptacle of the receiver, wherein the locking device comprises a locking lever for actuating the locking device;

a control block accommodated in a control block receptacle of the receiver, the control block having a bar guide slot formed therein;

a trigger that is pivotable in the receiver, wherein the trigger is pivotable about a trigger axis;

a sear bar coupled to the trigger, the sear bar extends to the control block, wherein the sear bar includes a guide bracket;

a locking bar having a guide lug, the locking bar interacts with the locking device, wherein the locking bar can be displaced between a rest position and an actuating position; and a lowering component accommodated in the control block, wherein the lowering component is displaceable, relative to the receiver, between a locking position and an unlocking position for removing the slide assembly from the receiver assembly, wherein the lowering component comprises:

a control window, wherein the guide bracket of the sear bar is guided in the control window; and a guide link, wherein the guide lug of the locking bar protrudes into the guide link, and wherein the guide lug protrudes through a bar guide slot formed in the control block.

14. The handgun of claim 13 wherein the slide assembly includes a slide having a first guide groove configured to guide the slide on the receiver assembly, and wherein the first guide groove includes a first recess having a first pressure bevel.

15. The handgun of claim 13 wherein the lowering component is formed as a single sheet metal piece.

16. The handgun of claim 13 wherein the lowering component includes a first lowering component wing and a second lowering component wing, and wherein the first lowering component wing and the second lowering component wing are coupled to each other by via a base, wherein the control window and the guide link are formed as a recess in the first lowering component wing.

17. The handgun of claim 16 wherein the base includes an abutment formed thereon, and wherein the abutment supports a lowering component return spring.

18. The handgun of claim 16 wherein the first lowering component wing includes a first wing extension formed thereon and the second lowering component wing includes a second wing extension formed thereon, wherein the first wing extension protrudes outside laterally with respect to the first lowering component wing, and wherein the second wing extension protrudes outside laterally with respect to the second lowering component wing, and wherein the first wing extension is configured to be guided in a first guide groove in a slide of the slide assembly, and wherein the second wing extension is configured to be guided in a second guide groove of the slide of the slide assembly.

19. The handgun of claim 18 wherein the first wing extension includes a first pressure surface thereon, the first pressure surface is configured to come into contact with a first pressure bevel of a first recess of the first guide groove, and wherein the second wing extension includes a second pressure surface formed thereon, the second pressure surface is configured to come into contact with a second pressure bevel of a second recess of the second guide groove.

20. The handgun of claim 18 wherein the control block includes a linear guide slot formed therein, wherein the linear guide slot is configured to guide the first wing extension.

* * * * *